US005567140A

United States Patent [19]

Dodd

[11] Patent Number: 5,567,140

[45] Date of Patent: Oct. 22, 1996

[54] KEYED INSERT PLATE FOR CURVED ROTARY LOBE PUMP CHAMBER WALLS

[75] Inventor: Ian Dodd, Rigaud, Canada

[73] Assignee: ITT Corporation, New York, N.Y.

[21] Appl. No.: 426,965

[22] Filed: Apr. 24, 1995

[51] Int. Cl.[6] ..... F04C 2/18

[52] U.S. Cl. ..... 418/178; 418/206.1

[58] Field of Search ..... 418/178, 206.1, 418/206.6

[56] References Cited

U.S. PATENT DOCUMENTS

| | | | |
|---|---|---|---|
| 1,590,964 | 6/1926 | Street | 418/178 |
| 1,927,395 | 9/1933 | Edwards | 418/206.6 |
| 3,680,990 | 8/1972 | Pettibone et al. | 418/178 |
| 5,037,283 | 8/1991 | Kapur et al. | 418/178 |
| 5,318,415 | 6/1994 | Verhoeven | 418/46 |

FOREIGN PATENT DOCUMENTS

| | | | |
|---|---|---|---|
| 41526 | 11/1887 | Germany | 418/206 |
| 1963981 | 7/1970 | Germany | 418/178 |
| 62-191684 | 8/1987 | Japan | 418/178 |
| 356168 | 9/1931 | United Kingdom | 418/206 |
| 2120728 | 12/1983 | United Kingdom | 418/178 |

*Primary Examiner*—John J. Vrablik

*Attorney, Agent, or Firm*—Menotti J. Lombardi

[57] ABSTRACT

A rotary lobe pump comprises a pump housing defining an obround pump chamber and a pair of lobe rotors in the pump chamber. The rotors are mounted on rotatable shafts which are connected by timing gears such that the rotors rotate to cause a fluid to displace through the chamber. The pump chamber is defined in the pump housing by opposed front and rear end walls which are perpendicular to the axes of the rotors and by arcuate side walls with which the rotors make sealing contact and which gradually wear out thereby reducing the tightness of the seal and thus the pumping efficiency of the rotary lobe pump. The rear end wall includes two removable end wear plates which each include a rearwardly projecting key engaged in a corresponding keyway defined in the pump housing with bolts extending from outside of the housing inwardly towards the end wear plates and engaging the keys thereof for securing the end wear plates to the housing. The arcuate side walls take the form of removable curved wear plates which are each semi-cylindrical in shape and which each include an outwardly directed radial curved key which is engaged in a corresponding curved keyway defined in the housing. Bolts which extend through the housing into the keys retain the curved wear plates in position in the pump chamber. The rear ends of the curved wear plates are supported by the peripheral edges of the end wear plates.

13 Claims, 3 Drawing Sheets

KEYED INSERT PLATE FOR CURVED ROTARY LOBE PUMP CHAMBER WALLS

BACKGROUND OF THE INVENTION

1. Field of the Invention

The present invention relates to rotary lobe pumps and, more particularly, to a keyed wear plate for the curved chamber walls of such rotary lobe pumps.

2. Description of the Prior Art

Rotary lobe pumps are well known industrial pumps which have been in common use for about forty years. A pair of counter rotating interlocking lobe rotors in a pump chamber draw fluid from an input port and expel the fluid through an output port. The pump is well suited to low velocity, high density fluid, especially sludge-like fluids. Examples of typical applications of rotary lobe pumps are chemical slurries, milk and sewage.

Such rotary lobe pumps typically include a pump chamber which houses the two lobe rotors and which defines an obround side wall with a removable front cover plate being provided at a front end of the pump chamber for selectively allowing access thereto. One lobe rotor is mounted on a drive shaft and the other on a driven shaft with the latter being driven by the drive shaft via timing gears. The pumping action of the pump results from the lobes which are interlocked and which turn at a same angular speed while maintaining the same relative phase angle. The rotors during the rotation thereof make peripheral sliding sealing contact with the walls defining the pump chamber, namely the obround side wall and the end walls which include the front cover plate and a rear wear plate.

With time, the lobe rotors wear out the obround side wall of the pump chamber thereby slowly reducing the efficiency of the seal which exists and which is necessary between the lobe rotors and the obround side wall. Furthermore, the end walls of the pump chamber, namely the front cover plate and the rear wear plate, also wear out in view of the sliding sealing contact thereof with the end surfaces of the lobe rotors, whereby these components have to be periodically replaced in order to ensure an appropriate seal. On the other hand, the peripheral obround side wall is not replaceable without replacing the pump housing of the rotary lobe pump.

SUMMARY OF THE INVENTION

It is therefore an aim of the present invention to provide a replaceable wear plate for the curved walls of the pump chamber of rotary lobe pumps.

It is also an aim of the present invention to provide a rotary lobe pump defining a pump chamber which is lined with a replaceable curved wear plate for each lobe rotor thereof.

It is a further aim of the present invention to provide a replaceable wear plate for the curved chamber walls of a rotary lobe pump, wherein the wear plate is keyed into position in the body of the pump radially outwardly of the pump chamber thereof and is retained to the pump body with bolts extending through the pump body and into the key provided on the outer surface of the wear plate.

Therefore, in accordance with the present invention, there is provided a rotary lobe pump comprising a pump housing, a pump chamber defined in said housing and having input and output ports provided in a side wall of said pump chamber, first and second rotors rotatably mounted in said pump chamber, said rotors having parallel axes of rotation, said pump chamber also having end walls perpendicular to said axes and said side wall, said rotors making continuous rolling sealing contact with each other and sliding sealing contact at the periphery thereof with at least part of said side wall, said side wall comprising first and second curved wear plates removably mounted to said pump housing in said pump chamber at locations of said side wall where said first and second rotors respectively make said sliding sealing contact.

Also in accordance with the present invention, there is provided a curved wear plate for use in rotary lobe pumps which each comprise a pump housing, a pump chamber defined in the housing and having input and output ports provided in a side wall of the pump chamber, a pair of rotors rotatably mounted in the pump chamber and making a continuous rolling sealing contact with each other, the rotors having parallel axes of rotation, the pump chamber also having end walls perpendicular to the axes and the side wall, a pair of said curved wear plates being adapted to be removably mounted to the side wall at locations in the pump chamber where peripheral surfaces of the rotors are required to make a sliding sealing contact, said curved wear plate defining an inner arcuate surface where said sealing contact with a respective rotor occurs and comprising mounting means outwardly of said inner surface for removably securing said curved wear plate to the pump housing.

BRIEF DESCRIPTION OF THE DRAWINGS

Having thus generally described the nature of the invention, reference will now be made to the accompanying drawings, showing by way of illustration a preferred embodiment thereof, and in which.

DESCRIPTION OF THE PREFERRED EMBODIMENTS

Figure 1:
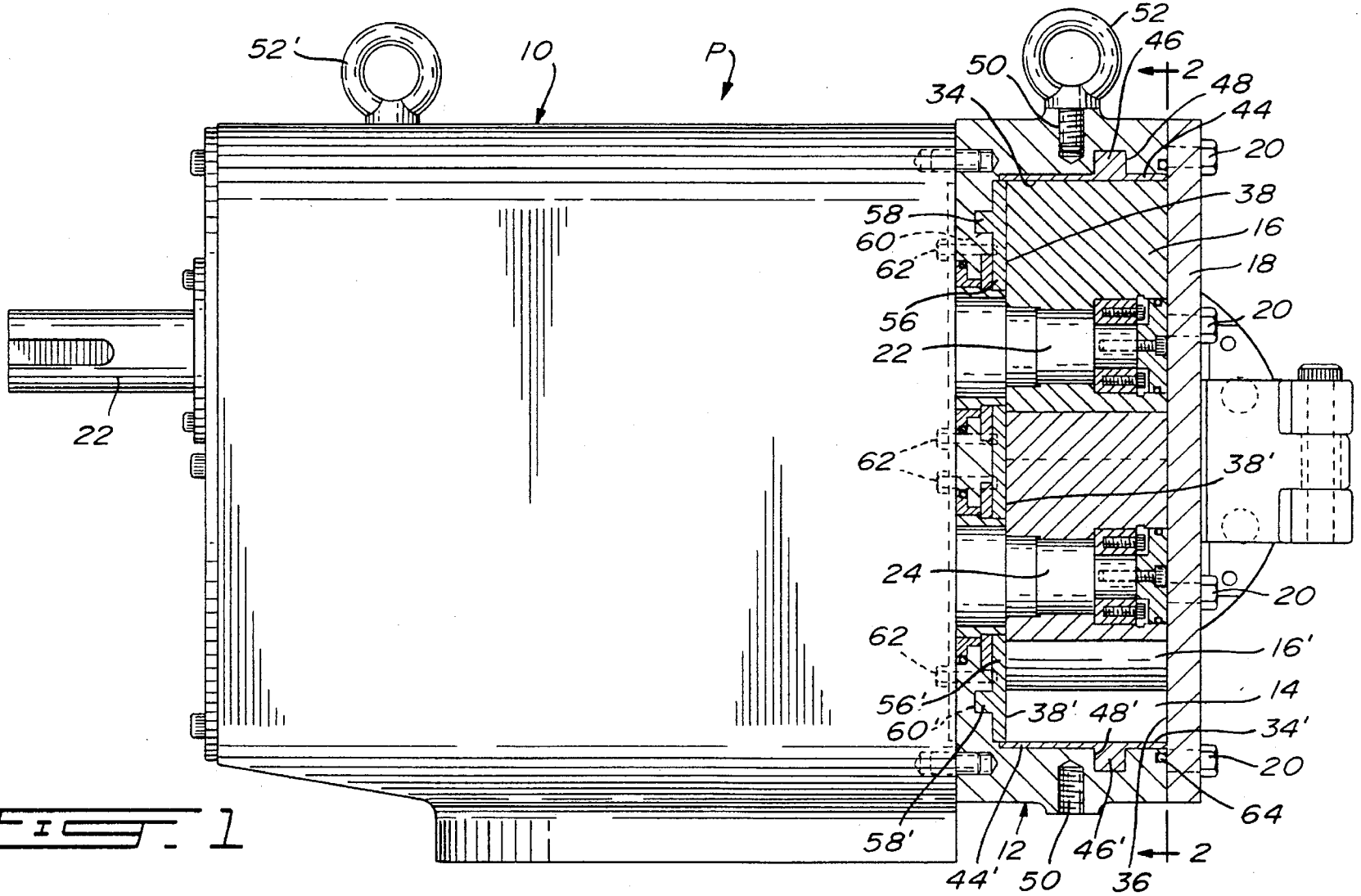
FIG. 1 is a side elevational view, partly in cross-section, of a rotary lobe pump comprising removable keyed curved wear plates in accordance with the present invention which are provided for the arcuate walls defined at ends of the pump chamber of the rotary lobe pump.

In accordance with the present invention, FIG. 1 illustrates a rotary lobe pump P which comprises a gearbox 10 and a pump housing 12 removably mounted at a front end of the gearbox 10. The pump housing 12 defines therein a pump chamber 14 (see FIG. 2), upper and lower lobe rotors 16 and 16' adapted for rotation in the pump chamber 14, a removable front cover plate 18 which closes the pump chamber 14 and which is secured to the pump housing 12 by way of bolts 20 for allowing access to the pump chamber 14, a main drive shaft 22 and a second auxiliary driven shaft 24, the upper and lower lobe rotors 16 and 16' being fixedly mounted to the drive shafts 22 and 24, respectively.

The main drive shaft 22 extends outwardly rearwardly of the gearbox 10 so as to be rotatably driven by a motor (not shown). With reference to U.S. Pat. No. 5,318,415 issued on Jun. 7, 1994, the second auxiliary shaft 24 within the gearbox 10 is driven by the main drive shaft 22 by way of timing gears so that both shafts 22 and 24 and thus the upper and lower lobe rotors 16 and 16' rotate at a same angular speed in order that the lobe rotors 16 and 16' can efficiently pump a desired fluid by way of the interlocking interaction between the lobe rotors 16 and 16' which again turn at the same speed while maintaining a same relative phase angle. Appropriate durable seals are provided in the gearbox 10 in order to seal the shafts 22 and 24 to the pump chamber 14. The shafts 22 and 24 are each journaled in the gearbox 10 to front and rear bearings for rotatably mounting the shafts 22 and 24 in the gearbox 10. The front bearings are provided close to the pump housing 12 so that the lobe rotors 16 and 16' which are mounted at the front ends of the shafts 22 and 24 respectively resist displacement even when subjected to the various forces encountered during pumping.

Figure 2:
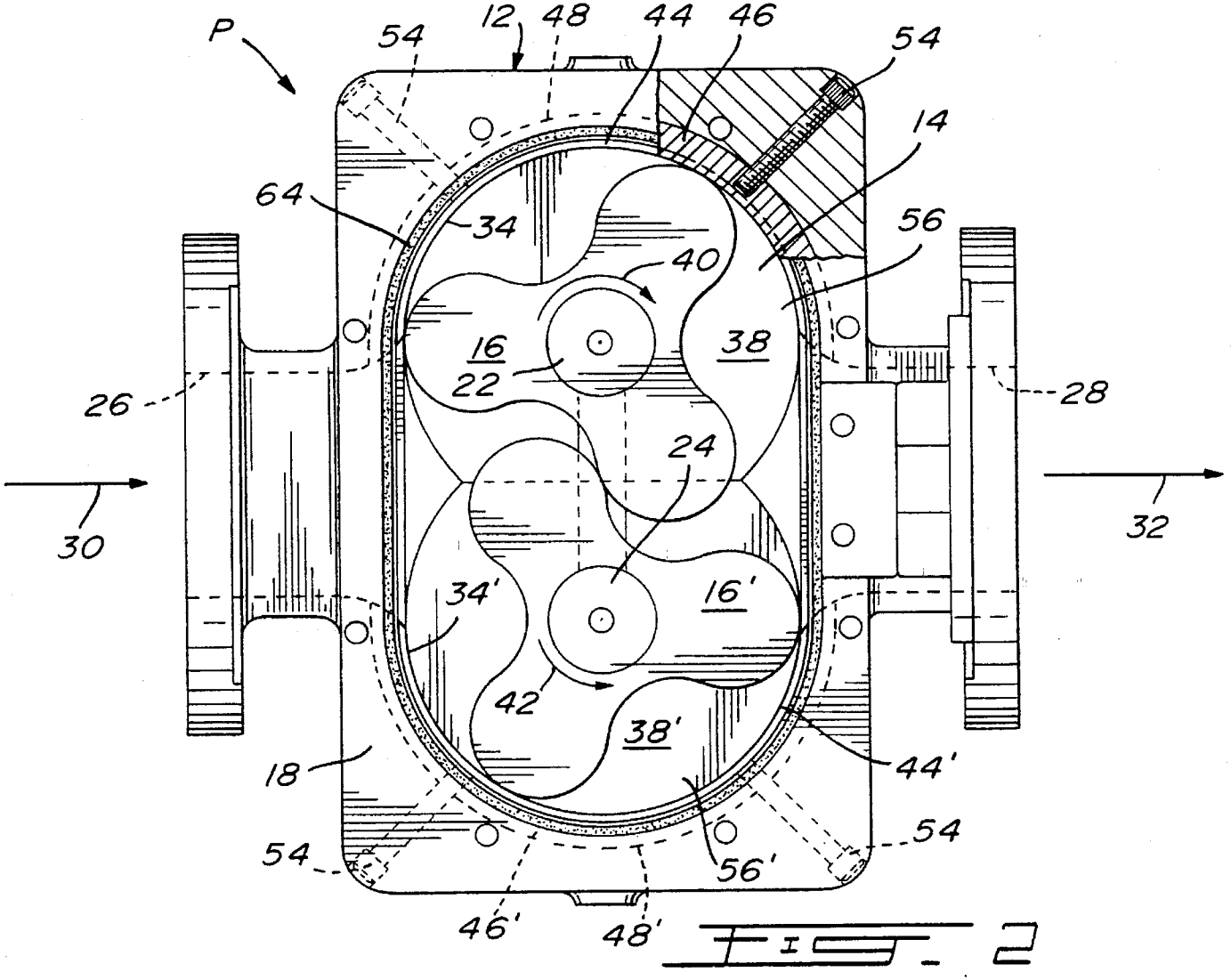
FIG. 2 is a fragmented side elevational cross-sectional view taken along line 2—2 of FIG. 1 and showing the rotary lobe pump of FIG. 1 without a front cover plate thereof.
Figure 4:
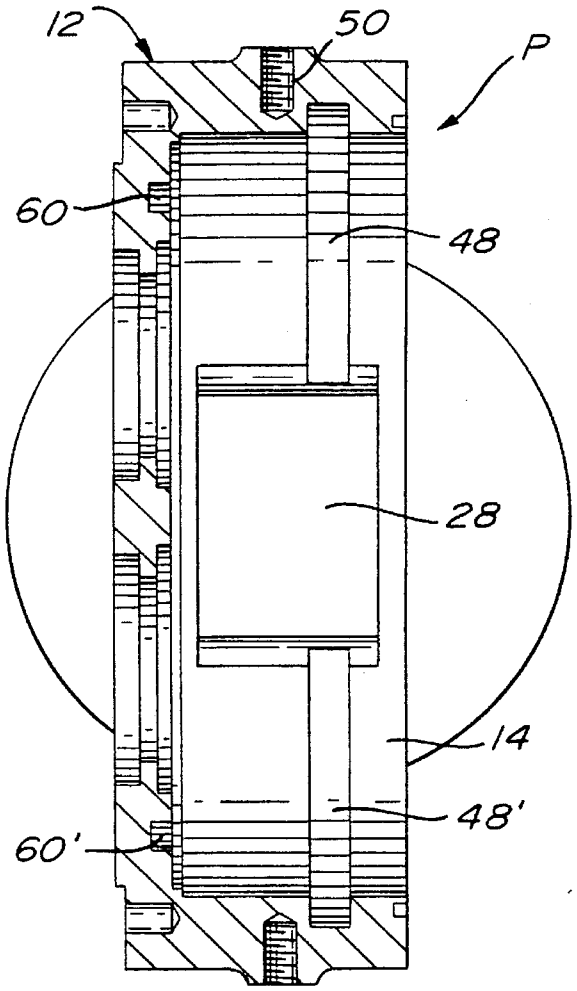
FIG. 4 is a cross-sectional view taken along line 4—4 of FIG. 3 but shown without the upper and lower arcuate wear plates of the rotary lobe pump which appear in FIG. 3.

Now mainly referring to FIG. 2, the pump housing 12 comprises an input port 26 and an output port 28 which are in fluid communication with the pump chamber 14 so that a rotation of the lobe rotors 16 and 16' causes the fluid to be pumped to enter the rotary lobe pump P by way of the input port 26 in the direction of arrow 30, to be pumped through the pump P by way of the interaction of the rotating lobe rotors 16 and 16', and to exit the pump P through the output port 28 along arrow 32.

More particularly, the pumping action of the rotary lobe pump P is created by the rotating lobe rotors 16 and 16' which interlock and turn at a same angular speed while maintaining the same relative phase angle. The lobe rotors 16 and 16' which can be rubber coated make sliding sealing contact with the side walls which define the pump chamber 14 having a generally obround shape, wherein these side walls include upper and lower arcuate side walls 34 and 34', respectively, a front end wall 36 (see FIG. 1), and upper and lower rear end walls 38 and 38' respectively.

Still referring to FIG. 2, the pumping action of the lobe rotors 16 and 16' results from the upper rotor 16 rotating clockwise along arrow 40 while the lower rotor 16' rotates counterclockwise along arrow 42. Due to the shape of the rotors 16 and 16', there is a continuous rolling sealing contact made between the rotors 16 and 16' as they turn, and the rotors each make peripheral sliding sealing contact with the arcuate side walls 34 and 34' respectively.

In accordance with the present invention, the upper and lower arcuate side walls 34 and 34' are respectively defined by upper and lower arcuate wear plates 44 and 44' which are removably mounted to the pump housing 12. The arcuate wear plates 44 and 44' each have substantially the shape of a half cylinder so as to coincide with the substantially semi-spherical upper and lower ends of the obround pump chamber 14. Each of the wear plates 44 and 44' defines on the outer surface thereof a substantially semi-annular key 46 and 46' which is engaged in a corresponding, that is of substantially semi-annular shape, groove or keyway 48 and 48' defined in the pump housing 12 at the upper and lower arcuate ends of the pump chamber 14, the engagement of the keys and keyways resist movement of the arcuate wear plates in the axial direction of the pump. The keyways 48 and 48' are defined forwardly of radially oriented threaded holes 50 which are defined in the outer surface of the pump housing 12 and which are adapted for receiving an eyebolt 52 for use in handling the rotary lobe pump P (a similar eyebolt 52' is engaged in a threaded hole which is identical to hole 50' and which is defined in the outer surface of the gearbox 10 as seen in FIG. 1).

The arcuate wear plates 44 and 44' are secured to the pump housing 12 by way of bolts 54 (see FIG. 2) which extend from outside of the pump housing 12 radially inwardly towards respective lobe rotors 16 and 16' and which threadably engage the keys 46 and 46' of the wear plates 44 and 44'. In the illustrated embodiment there are two such bolts 54 for each one of the wear plates 44 and 44'. As best seen in FIG. 1, the wear plates 44 and 44' are supported at the rear end thereof by the peripheral edges of the rear end walls 38 and 38'.

Figure 3:
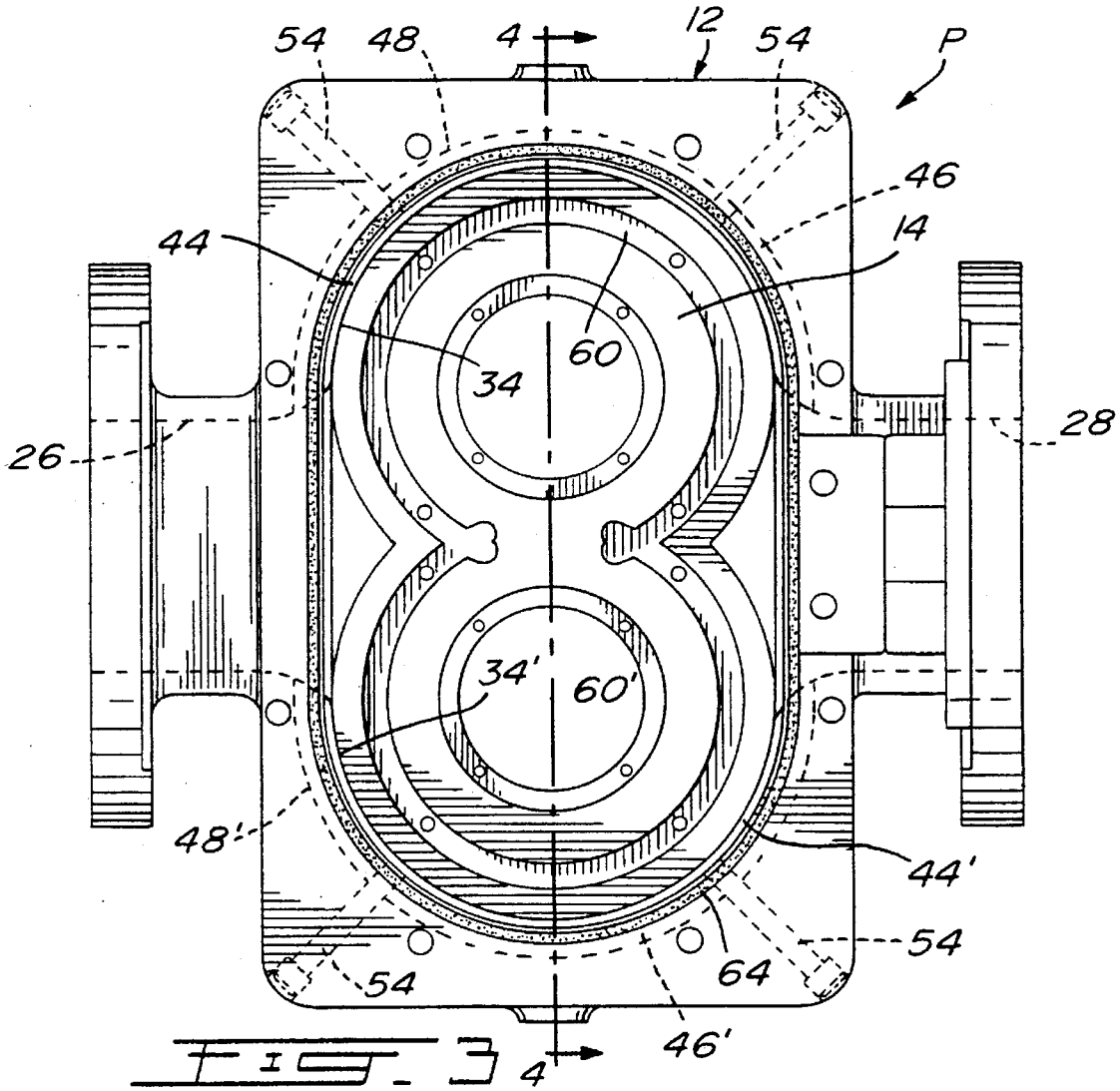
FIG. 3 is a side elevational view, similar to FIG. 2 but wherein the two rotors, the two shafts and the two rear wear plates of the rotary lobe pump in addition to the front cover plate have been removed for illustration purposes.

The rear end walls 38 and 38' are herein embodied in a pair of rear wear plates 56 and 56', respectively. The rear wear plates 56 and 56' each have the shape of disc which is missing a segment at the point of abutment of the two rear wear plates 56 and 56' centrally in the pump chamber 14 and reference is made to FIG. 2. Also, the rear wear plates 56 and 56' each define centrally thereof an opening for allowing the drive shafts 24 and 26 to extend forwardly to the lobe rotors 16 and 16'. The rear wear plates 56 and 56' each comprise on a rear surface thereof a rearwardly projecting curved key 58 and 58', respectively, which engages an arcuate keyway 60 and 60' defined in the rear wall of the pump housing 12 adjacent the gearbox 10, as best seen in FIGS. 1 and 3. Bolts 62 which extend inwardly through the rear wall of the pump housing 12 engage the rear wear plates 56 and 56' to secure the same to the pump housing 12. The outer peripheral ends of the rear wear plates 56 and 56' support the rear ends of the arcuate wear plates 44 and 44' so as to retain the latter in position in outward abutment against the pump housing 12.

For replacing the rear wear plates 56 and 56', the bolts 20 are removed to separate the front cover plate 18 from the pump housing 12 (and from a peripheral torus-shaped gasket or seal 64 mounted in the pump housing 12 opposite the front cover plate 18); the lobe rotors 16 and 16' are disengaged from the drive shafts 22 and 24 and removed from the pump housing 12, and finally the bolts 62 are removed to disengage the rear wear plates 56 and 56' from the pump housing 12 thereby allowing for the removal and replacement of the rear wear plates 56 and 56'.

If the arcuate wear plates 44 and 44' need to replaced, the bolts 54 are removed, whereby, with the rear wear plates 56 and 56' and the lobe rotors 16 and 16' being removed, the arcuate wear plates 44 and 44' can be disengaged and removed from the pump housing 12 by displacement thereof towards the center of the pump chamber 14, that is in a direction so as to withdraw the keys 46 and 46' thereof from the keyways 58 and 58'. New arcuate wear plates 44 and 44' can then be installed followed by the installation of the same or of new rear wear plates 56 and 56'. The lobe rotors 16 and 16' are mounted to the drive shafts 22 and 24 and the front cover plate 18 is secured to the pump housing 12.

I claim:

1. A curved wear plate for use in a rotary lobe pump of the type comprising a pump housing, a pump chamber defined in the housing and having input and output ports provided in a side wall of the pump chamber, a pair of rotors rotatably mounted in the pump chamber and having a continuous rolling sealing contact with each other, the rotors having parallel axes of rotation, the pump chamber also having end walls perpendicular to the axes and the side wall, the side wall of said pump chamber being adapted to removably receive said curved wear plate at locations in the pump chamber where peripheral surfaces of the rotors are required to make sliding sealing contact, said curved wear plate defining a smooth inner arcuate surface where said sealing contact with a respective rotor occurs, said curved wear plate comprising an arcuate key means projecting outwardly of an outer surface of said curved wear plate, said key means being adapted to be removably engaged in a corresponding keyway means defined in the pump housing and comprising mounting means for removably securing said arcuate key means and thus said curved wear plate to the pump housing.

2. A curved wear plate as defined in claim 1, wherein said mounting means comprise at least one bolt means adapted to extend in the pump housing inwardly towards and at least partly into said key means.

3. A curved wear plate as defined in claim 1, wherein said rotary lobe pump comprises a rear wear plate covering a rear one of said end walls, said curved wear plate fitting between a peripheral edge of said rear wear plate and said side wall of said pump housing, and said key means of said curved wear plates is provided closer to a front end thereof whereby said curved wear plates are securely mounted to said pump housing by the action of said rear wear plate at a rear end of said curved wear plates and by said mounting means acting on said key means near the front end of said curved wear plates.

4. A curved wear plate as defined in claim 3, wherein a front end wall of said pump housing comprises a removable cover plate.

5. A rotary lobe pump comprising a pump housing, a pump chamber defined in said housing and having input and output ports provided in a side wall of said pump chamber, first and second rotors rotatably mounted in said pump chamber, said rotors having parallel axes of rotation, said pump chamber also having end walls perpendicular to said axes and said side wall, said rotors making continuous rolling sealing contact with each other and peripheral sliding sealing contact at the periphery thereof with at least part of said side wall, said side wall comprising first and second curved wear plates removably mounted to said pump housing in said pump chamber at locations of said side wall where said first and second rotors respectively make said peripheral sliding sealing contact, said first and second curved wear plates each comprising an arcuate key means projecting outwardly into said pump housing, said key means being removably engaged in a corresponding keyway means provided in said pump housing, said key means and keyway means extending in the direction of rotation so as to resist movement of the curved wear plates in the axial direction, mounting means being provided for securing said key means of each said curved wear plate to said pump housing, said key means and keyway means extending in the direction of rotation so as to resist movement of the curved wear plate in the axial direction.

6. A rotary lobe pump as defined in claim 5, wherein said mounting means comprise at least one bolt means extending in said pump housing inwardly towards and at least partly into said key means.

7. A rotary lobe pump as defined in claim 5, wherein said end walls comprise at least one end wear plate removably mounted to said pump housing, said rotors making end sliding sealing contact with said end wear plate at at least one end surface of said rotors, said at least one end wear plate supporting an end edge of said curved wear plates against said pump housing.

8. A rotary lobe pump as defined in claim 7, wherein said key means is located at least partly opposite an eyebolt engaged from the outside partly into said pump housing.

9. A rotary lobe pump as defined in claim 7, wherein said at least one end wear plate is a rear wear plate, and said key means of said curved wear plates is provided closer to a front end thereof whereby said curved wear plates are securely mounted to said pump housing by the action of said rear wear plate at a rear end of said curved wear plates and by said mounting means acting on said key means near the front end of said curved wear plates.

10. A rotary lobe pump as defined in claim 9, wherein a front end wall of said pump housing comprises a removable cover plate.

11. A rotary lobe pump as defined in claim 9, wherein an eye-bolt is secured into said side wall of said pump housing with an end of said eye-bolt terminating adjacent said keyway means at a point closer to said rear end wall than said keyway means, an end point of said eye-bolt being radially closer to a proximate one of said axes of rotation than is an outer bottom surface of said keyway means.

12. A rotary lobe pump as defined in claim 9, wherein said rear wear plate defines a smooth inner plane surface with which said rotor makes said rear sliding sealing contact and a second key means projecting outwardly of an outer surface of said rear wear plate, said second key means being removably engaged in a corresponding second keyway means defined in said pump housing, second mounting means being provided for securing said rear wear plate to said pump housing.

13. A rotary lobe pump as defined in claim 12, wherein said second mounting means comprise at least a second bolt means extending in said pump housing inwardly towards and at least partly into said second key means.

* * * * *